US005829534A

United States Patent [19]

Easton et al.

[11] Patent Number: 5,829,534

[45] Date of Patent: Nov. 3, 1998

[54] HARD SURFACE PREPARATION DEVICE

[75] Inventors: John Easton, Oconomowoc; Duane J. Swatck, Watertown; Dan Jennett, Milwaukee; Paul Pederson, Sheboygan; Larry Marincic, Waukesha, all of Wis.

[73] Assignee: SurfPrep, Inc., Pewaukee, Wis.

[21] Appl. No.: 740,624

[22] Filed: Oct. 31, 1996

[51] Int. Cl.[6] ..... B32B 31/18

[52] U.S. Cl. ..... 172/40; 299/37.1; 30/169

[58] Field of Search ..... 172/40; 299/37.1; 404/113, 114; 30/169, 170

[56] References Cited

U.S. PATENT DOCUMENTS

| | | | |
|---|---|---|---|
| 1,581,705 | 4/1926 | Waxbom . | |
| 2,619,748 | 12/1952 | McIntosh . | |
| 3,376,071 | 4/1968 | Stein | 299/37.1 |
| 3,396,642 | 8/1968 | Martinson . | |
| 3,478,450 | 11/1969 | Cunningham | 37/141 |
| 3,777,500 | 12/1973 | Kelley | 61/72.6 |
| 4,394,052 | 7/1983 | Adams et al. . | |
| 4,454,666 | 6/1984 | Gurries et al. | 37/118 |
| 4,704,812 | 11/1987 | Paramore, Jr. | 37/141 |
| 5,033,796 | 7/1991 | Odean | 299/37.1 |
| 5,641,206 | 6/1997 | Craft | 299/37.1 |
| 5,702,161 | 12/1997 | Finney et al. | 299/37.1 |

*Primary Examiner*—Michael J. Carone
*Assistant Examiner*—Christopher J. Novosad
*Attorney, Agent, or Firm*—Godfrey & Kahn, S.C.

[57] ABSTRACT

A hard surface preparation device for use in the removal of membranes, paving materials, flooring, tiles, roofing materials, and other materials from relatively hard surfaces such as concrete. The device includes two frames; a base frame and a second frame pivotally mounted to the base frame. The base frame is coupled to a small tractor by means of mounting brackets. The mounting brackets are bolted or otherwise secured to a moveable, powered mounting plate which is coupled to the hydraulically powered arms of the tractor, thereby permitting the device to be raised or lowered like any other front-end implement used with such a tractor. A motor or power take off from the tractor drives an eccentric shaft mounted on the base frame. A sleeve fits over the eccentric shaft and transforms the elliptical movement of the shaft into a back and forth motion. A blade mounted to the second frame is also coupled to the sleeve and, therefore oscillates when the motor is turned on. In use, the device is lowered by the arms of the tractor until the blade contacts a surface of interest. The forward motion of the tractor combined with the oscillation of the blade, causes the device to peel or chip away unwanted material from the underlying relatively hard surface.

19 Claims, 7 Drawing Sheets

HARD SURFACE PREPARATION DEVICE

FIELD OF THE INVENTION

The present invention relates generally to devices used to prepare concrete and other hard surfaces for resurfacing and other repairs. More particularly, the present invention relates to a device that is capable of removing membranes, paving materials, roofing materials, tiles, flooring, and other laid-on or deposited matter from hard surfaces.

BACKGROUND OF THE INVENTION

In many situations it is desirable to prepare a hard surface by removing a layer of worn, damaged, or otherwise obsolete material from the hard surface. Typically, this need arises in the repair of roads, floors, roofs, tennis courts, and the like where a layer of material or a membrane is laid upon a base of concrete. Examples of the materials to be removed include asphalt, rubber, tile, carpeting, roofing shingles, tar, vinyl, and other items. In the past, removal was done by hand with relatively large work crews using shovels, scrapers, and other hand tools. More recently, there have been some attempts to use small tractors, designed for earth moving applications, with vertical blades on their front ends to push and scrape away materials. However, these attempts have been less than satisfactory because the tractor-blade devices are incapable of removing some materials. In other cases, they only partially remove the object material from the underlying surface, leaving remnants of the material behind. These remnants must be removed in order to prepare the surface for resurfacing. Sometimes they can be removed by making a second pass over the hard surface with the tractor-blade device, but most often their removal must be done manually.

Thus, it would be desirable to have a hard surface preparation device capable of removing a relatively large number of different materials from a hard surface. It would also be desirable to have a hard surface preparation device which removes all or nearly all of the object material in a single pass, thereby minimizing the need to remove any material by hand.

OBJECTS AND SUMMARY OF THE INVENTION

Therefore, it is the object of the present invention is to provide a hard surface preparation device.

Another object of the present invention is to provide a hard surface preparation device that is capable of removing a wide variety of materials.

Another object of the present invention is to provide a hard surface preparation device that removes all or nearly all of an object material in a single pass.

These and other objects are achieved in a hard surface preparation device that includes a first or base frame having a means, such as mounting brackets, for being coupled to a mounting plate which is connected to the power-adjustable arms of a small tractor, such a skid-steer tractor. A weight holding frame is mounted on the base frame and one or more weights may be placed on the weight holding frame to add additional down force to the device. A motor, such as a hydraulic motor, is mounted on the base frame. The hydraulic motor is powered by hydraulic power take off from the tractor. The output shaft of the motor is coupled to an eccentric shaft, also mounted on the base frame. The output shaft may be coupled to the eccentric shaft by a belt and pulleys, a chain and sprockets, a drive shaft, or the like. A sleeve is positioned over the eccentric shaft and is used to transform the eccentric-rotational movement of the shaft into a back and forth motion.

The first end of a second or pivot frame is pivotally mounted to the base frame. The second end of the pivot frame has a second or motion-transfer shaft. A spacer is positioned between, and coupled to, the sleeve and the motion-transfer shaft. A blade is coupled to the motion-transfer shaft and a shield for protecting the motor and the base and second frames is coupled to the second frame and is positioned adjacent to the blade.

When the motor is activated, the eccentric shaft rotates in an elliptically-shaped path within the sleeve. While the sleeve surrounds the eccentric shaft, it is otherwise free to move, and as the eccentric shaft rotates, this motion causes the sleeve to oscillate in a back and forth manner. The oscillation is transferred to the spacer which in turn causes the motion-transfer shaft and, ultimately, the blade to oscillate. As the device is applied to a material to be removed, the downward force of the blade as well as the oscillating motion of the blade and the forward motion of the tractor causes material to be cut away from the underlying harder material. When softer, relatively pliant materials are removed, they will often lift away from the underlying surface in the form of a peel which is directed forward to coil within itself by the shield. When harder materials are removed, the shield protects the device from debris that may shoot up from the surface being prepared.

Other objects, features, and advantages of the present invention will become more apparent by reference to the detailed description of the invention and the accompanying drawings.

DETAILED DESCRIPTION OF THE INVENTION

Figure 1:
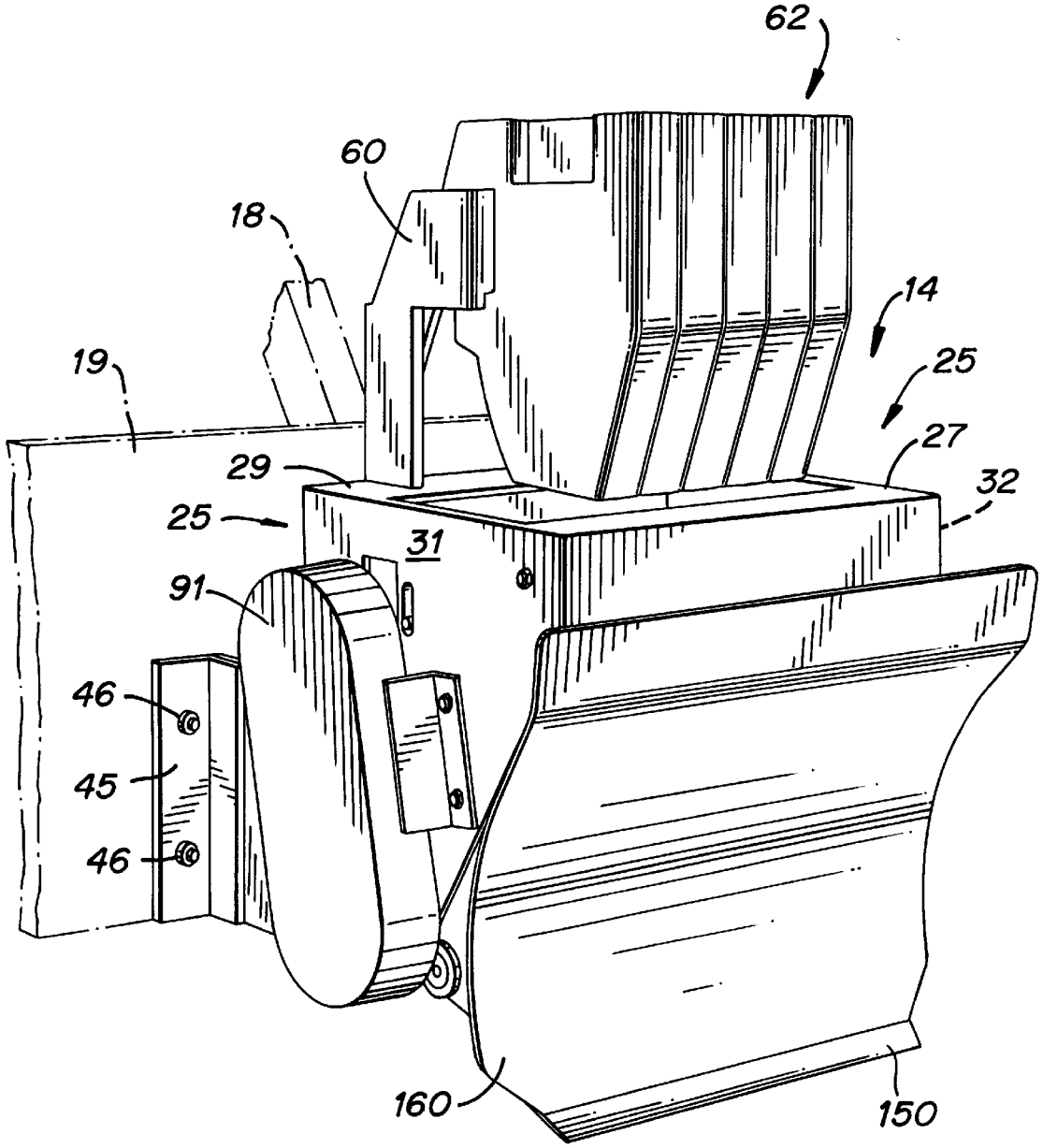
FIG. 1 is a perspective view of the hard surface preparation device of the present invention.
Figure 9:
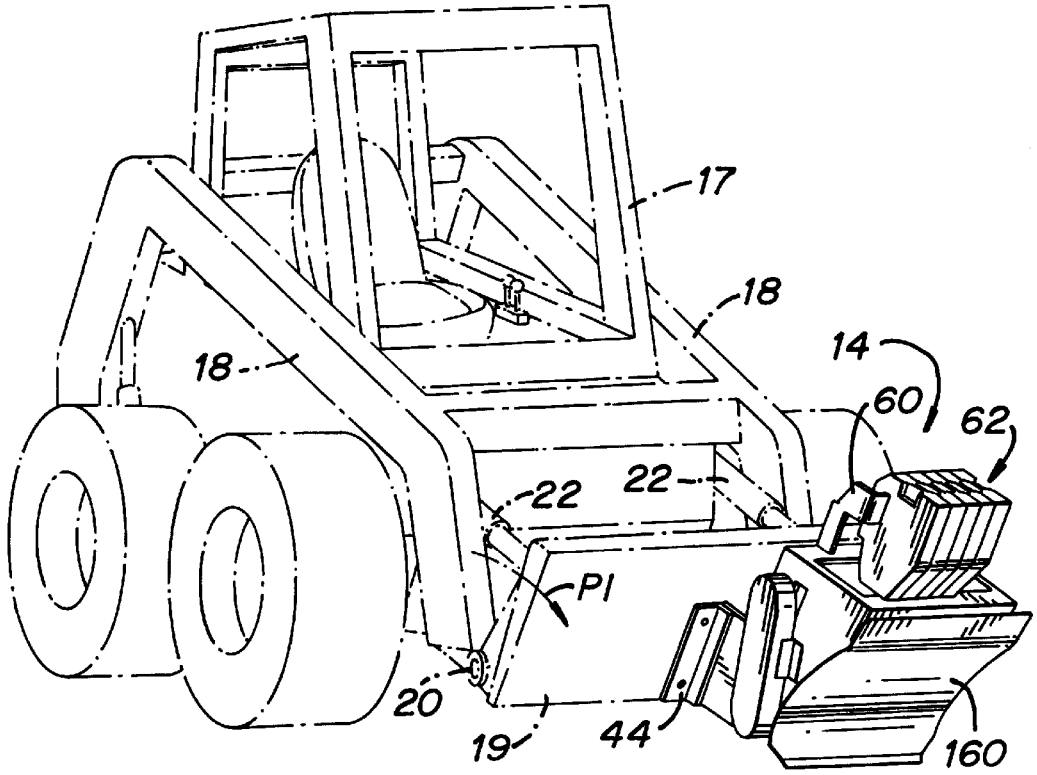
FIG. 9 is a perspective view of the hard surface preparation device of the present invention shown coupled to a small tractor and in a downwardly angled position.
Figure 10:
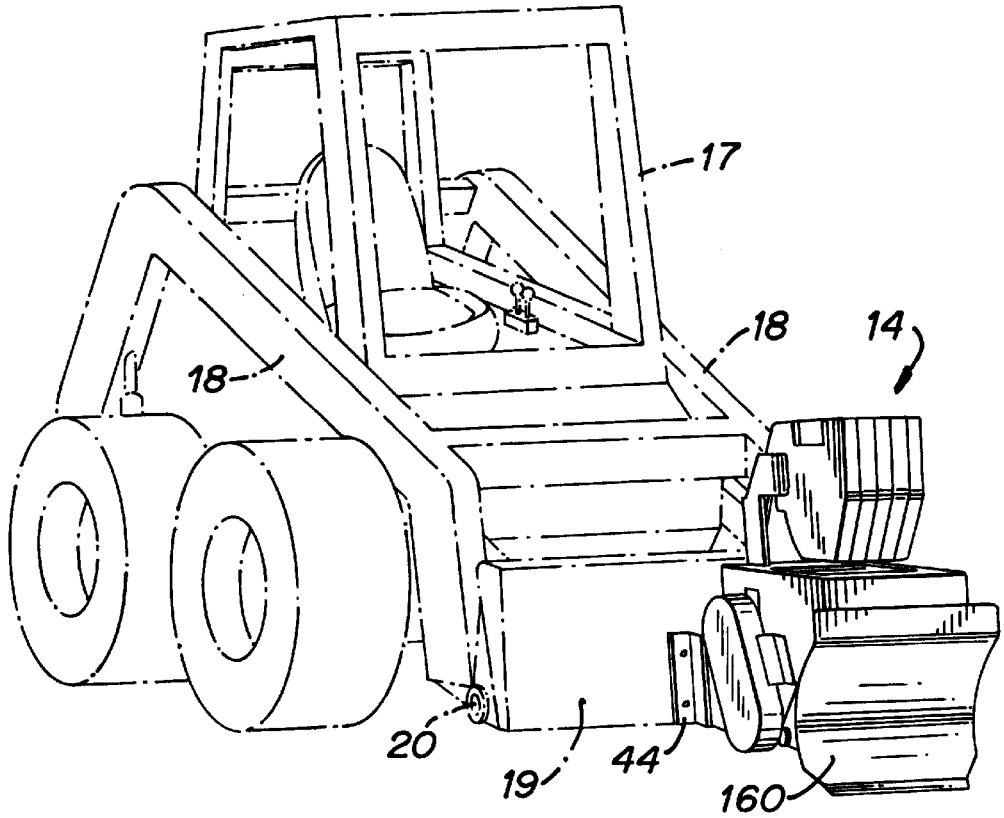
FIG. 10 is another perspective view of the hard surface preparation device of the present invention shown coupled to a small tractor and in a substantially horizontal position.

A hard surface preparation device 14 is shown in FIG. 1. The device 14 is designed to be mounted to a small tractor or any device which is self-propelled, e.g., a skid-steer tractor 17 (FIGS. 9 and 10). The skid-steer tractor 17 has one or more power-adjustable arms, such as hydraulically-powered arms 18. In most skid-steer tractors, a mounting plate 19 can be attached to the end of the arms 18 in place of a front bucket (not shown), the implement most commonly employed with skid-steer tractors. The mounting plate 19 pivots on two pins 20 (only one is shown), one on each arm 18. The pivoting of the mounting plate 19 is controlled by two hydraulic actuators 22. In the preferred embodiment, the mounting plate is made from metal and weighs about 150 pounds. Those skilled in the art know various mounting plates suitable for use on the skid-steer tractor 17 and how to mount and operate them.

The spatial position of the mounting plate 19 is controlled in the same manner as a front bucket is and with the same controls (not shown). Thus, the arms 18 of the skid-steer tractor 17 may be used to lift the device 14 up and down. In addition, movement of the actuators 22 causes the device 14 to rotate along a curved path, e.g., the path P1 (FIG. 9).

Figure 7:
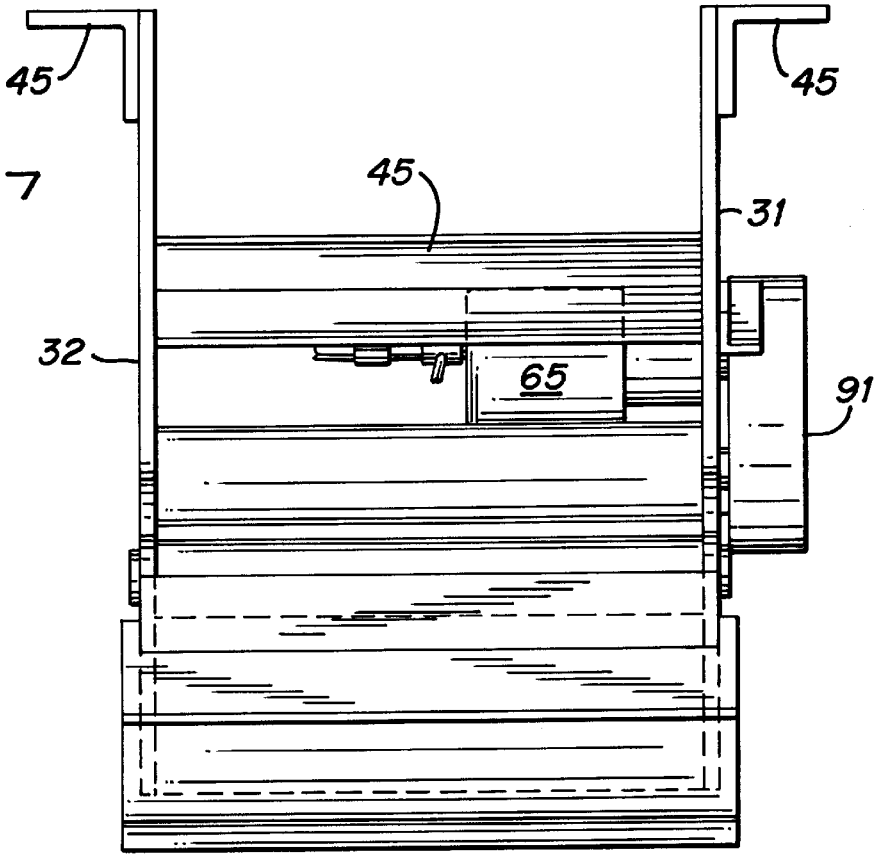
FIG. 7 is a bottom, plan view of the hard surface preparation device of the present invention.

The device 14 includes a first or base frame 25 (FIG. 8) constructed from angle iron or other suitably strong components. The frame includes two crosspieces 27 and 29. Mounted on the ends of the crosspieces are two side plates 31 and 32. The side plate 31 has an angled first end 33, a straight second end 35, a top end 37, and a bottom end 39. Similarly, the side plate 32 has an angled first end 40, a straight second end 41, a top end 42, and a bottom end 43. A third cross piece 45 (FIG. 7) is mounted between the plates 31 and 32 near each of their bottom ends 39 and 43. Mounted on each of the side plates 31 and 32 is brace 44 for mounting the device 14 to the mounting plate 19. In the embodiment shown, each brace 46 has two bores 47 each for receiving a bolt which is then secured to the mounting plate 19 by any suitable removable means of such as a nut.

Figure 6:
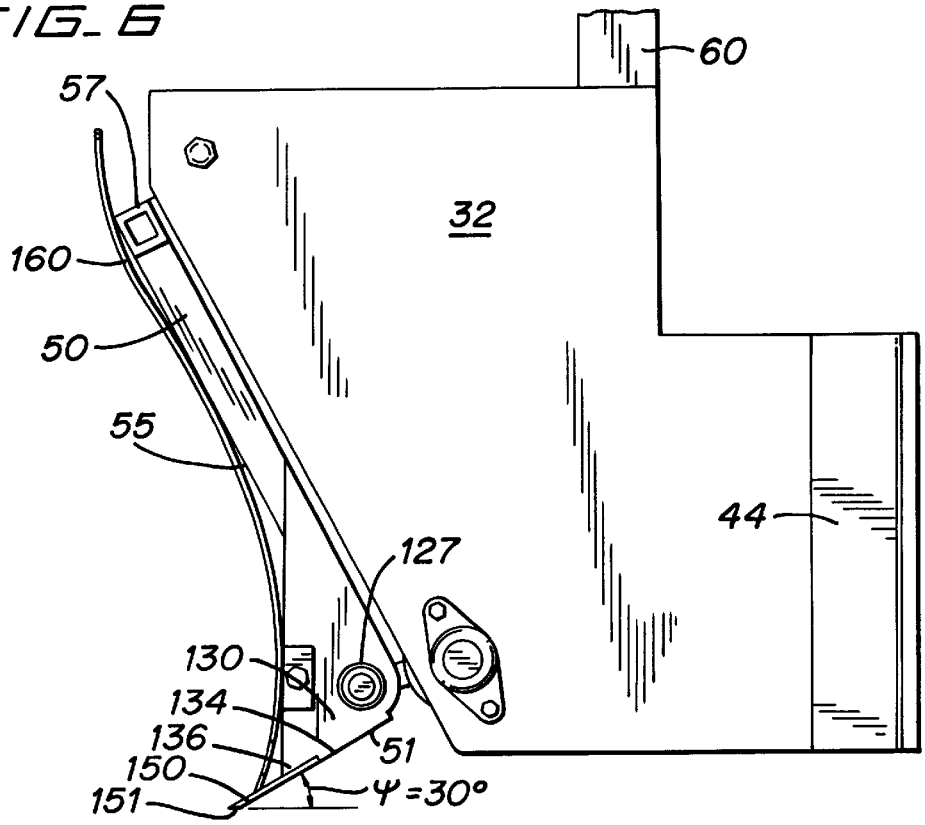
FIG. 6 is left side, elevational view of the hard surface preparation device of the present invention.
Figure 8:
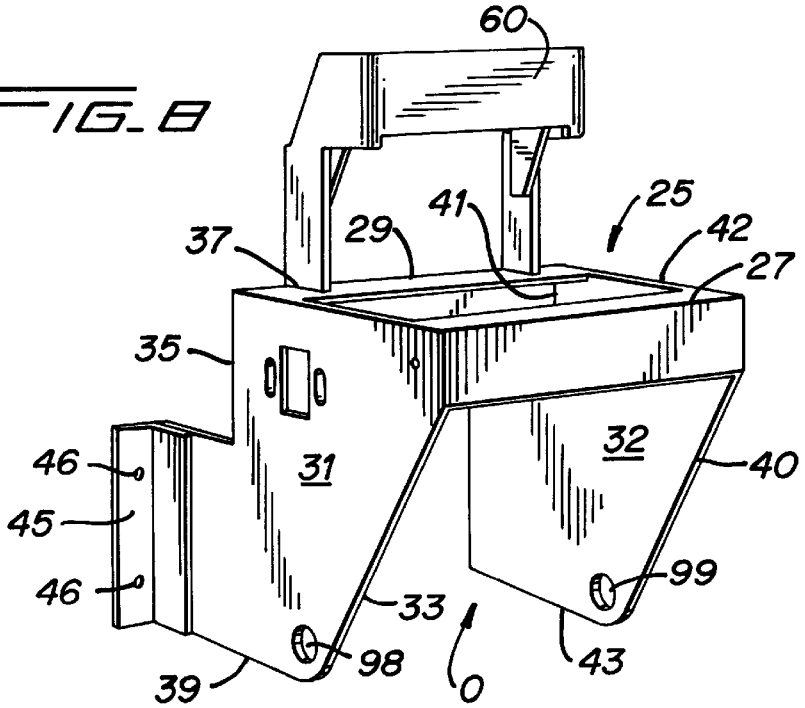
FIG. 8 is perspective view of the base frame of the hard surface preparation device of the present invention.

As best by reference to FIG. 8, the plates 31 and 32 define an opening O. As best seen by reference to FIGS. 3 and 6, the device 14 also includes a second or pivot frame 50, which is pivotally mounted on the in the opening O. The pivot frame has a bottom 51, a right side 53, a left side 55, and a top 57. The top 57 of the pivot frame 50 is mounted at a first point 58 (FIG. 2), near the top end 37 of the angled first end 33 of the side plate 31, and at a second point 59, near the top end 42 of the angled first end 40 of the side plate 32.

Also mounted on the base frame 25, on the cross piece 29, is a means for holding weights, e.g., a frame 60, to which one or more discrete weights 62 may be mounted. Such weights are well known in the art and are the same as those used with various agricultural and earth moving equipment. Each plate might weigh about 50 to 100 pounds, but the number used and weight of each will vary according to the application at hand.

Figure 2:
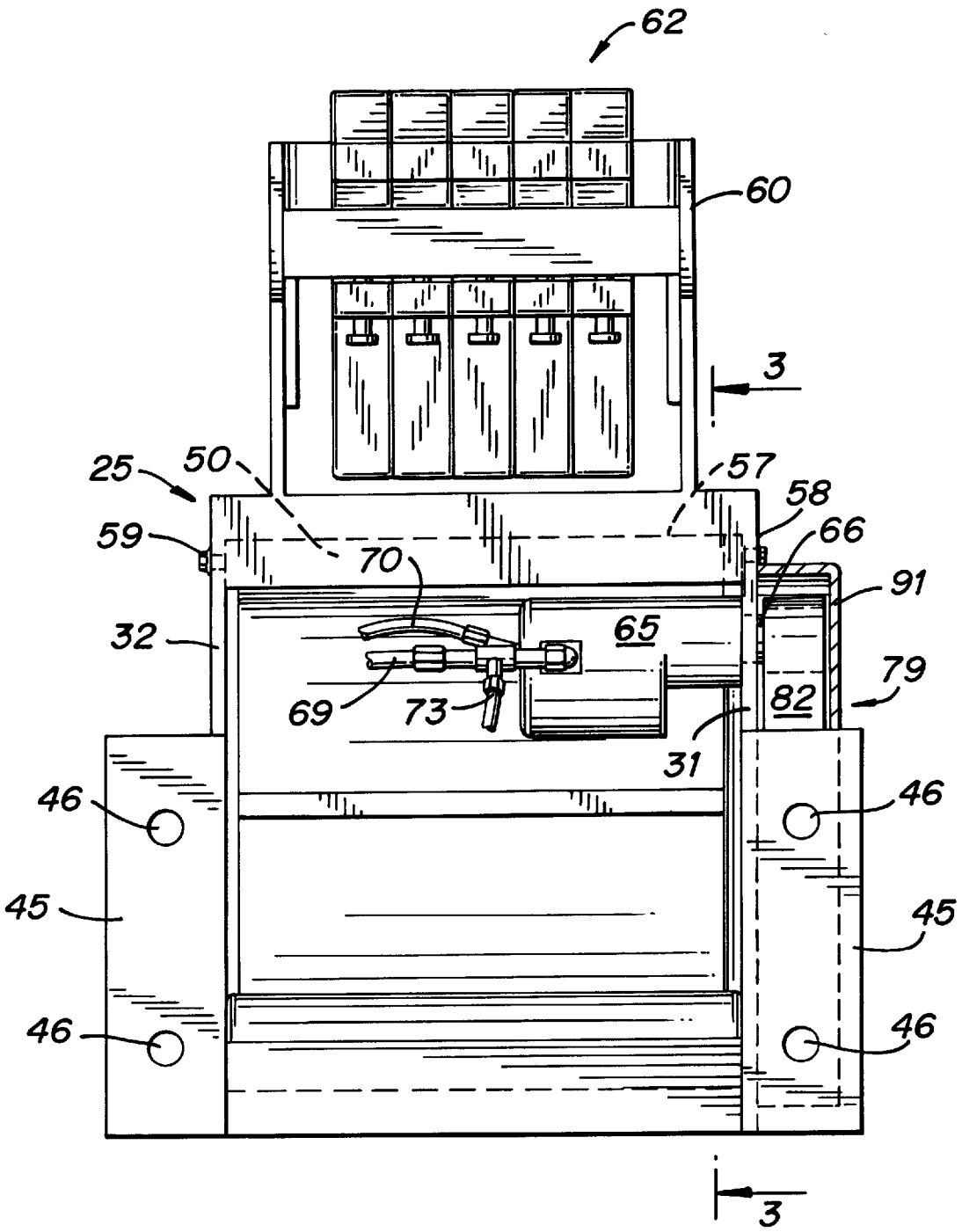
FIG. 2 is a rear, elevational view of the hard surface preparation device of the present invention.
Figure 3:
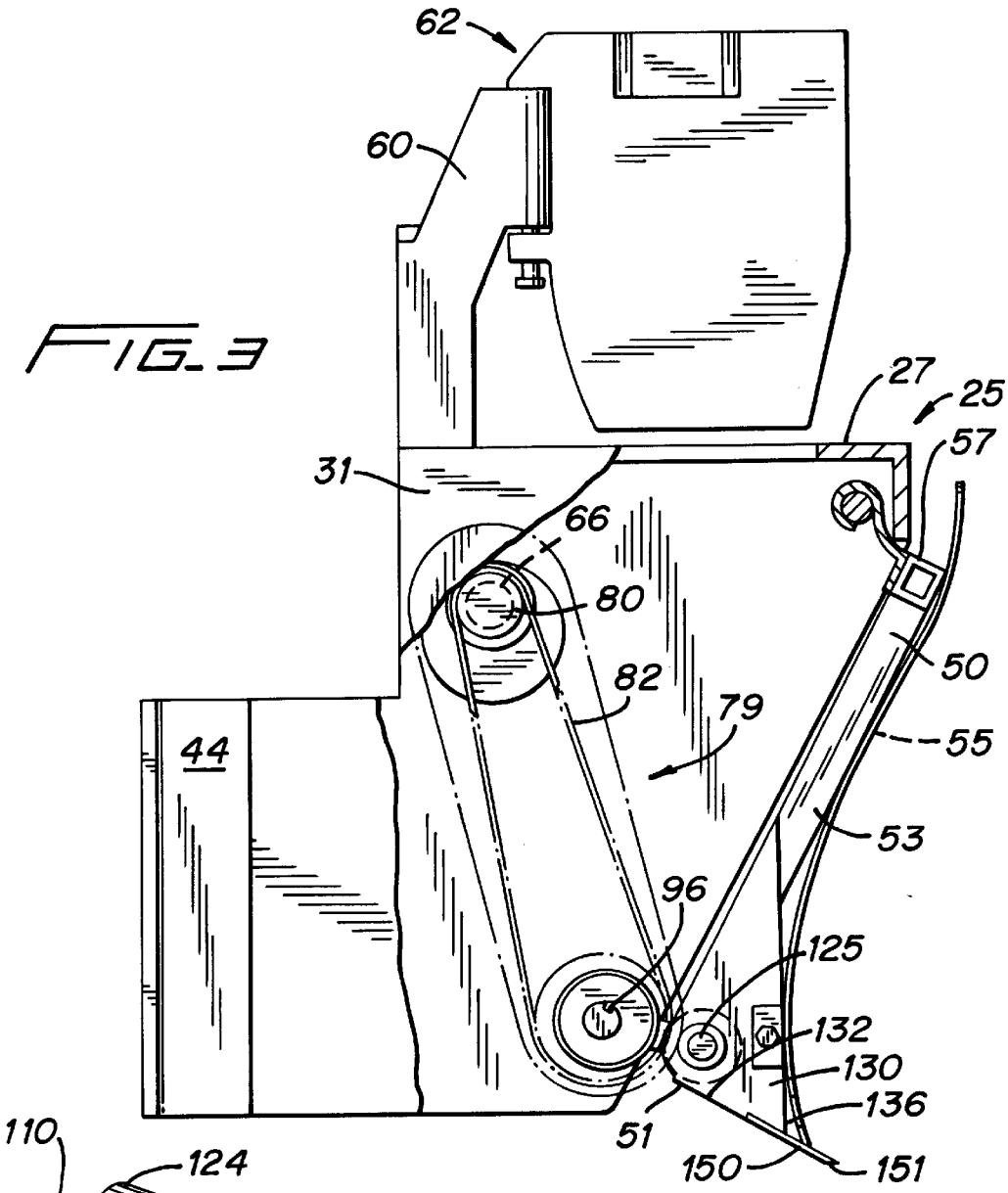
FIG. 3 is a cross-sectional view of the hard surface preparation device of the present invention taken along the line 3—3 of FIG. 2.

As best seen by reference to FIGS. 2 and 3, mounted on the first plate 31 of the base frame 25 is a hydraulic motor 65 of conventional design powered by an auxiliary hydraulic unit of the skid-steer tractor 17. The motor 65 has an output shaft 66, an inlet 69, and an outlet 70, and a bypass 73. The inlet 69 is coupled to an auxiliary or hydraulic power take off (not shown) of the skid-steer tractor 17 by a hydraulic line (not shown). The outlet 70 is coupled to a hydraulic power return (also not shown) on the skid-steer tractor by another hydraulic line (also not shown). Thus, the hydraulic power of the skid-steer tractor 17 drives the motor 65. Preferably, the hydraulic motor should be capable of producing about 2000 lb-inches of torque, although the amount of power and torque needed could be substantially more or less depending on the size of the device 14, which can be changed based on the application for which the device 14 is used. In addition, the hydraulic motor should be capable of driving the output shaft at several hundred revolutions per minute (rpm) and, preferably, between 500 and 1500 rpm. Controls of the kind known to those skilled in the art and readily available through various commercial suppliers are mounted on the skid-steer tractor 17 to control the flow of hydraulic fluid to the motor 65, including turning the flow on and off.

While it is preferred that a hydraulic motor be used in order to take advantage of the hydraulic power take off of the skid-steer tractor 17, various other motors could be used in the present invention provided they were capable of producing the necessary torque, and rpm. Electric motors and even fossil fuel motors might be suitable substitutes for the motor 65 shown. Moreover, conventional power-take-off could be used to power the oscillating components (discussed below) of the device 14. The device merely requires a means for providing rotational power.

Figure 4:
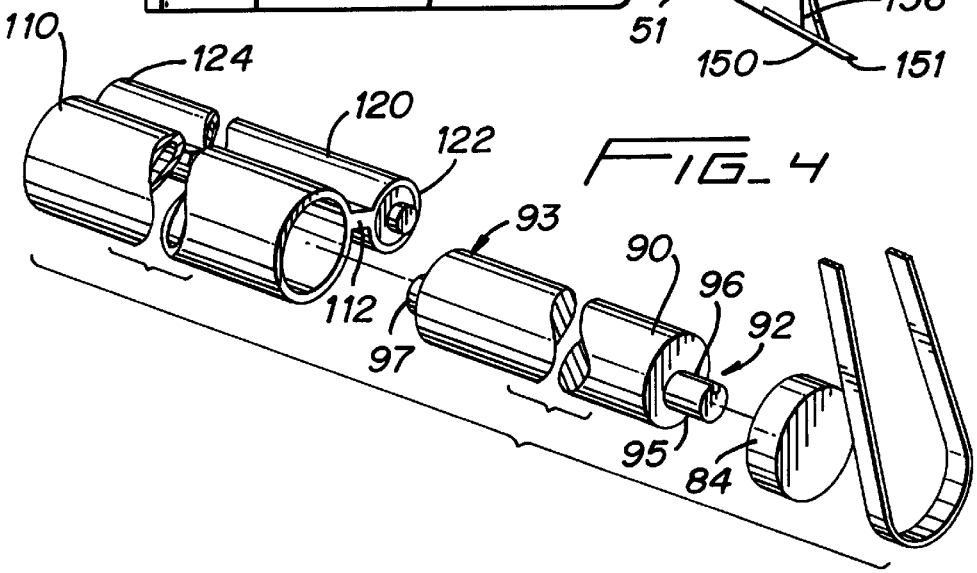
FIG. 4 is an exploded, perspective view of the eccentric shaft and the sleeve surrounding the eccentric shaft of the hard surface preparation device of the present invention.
Figure 5:
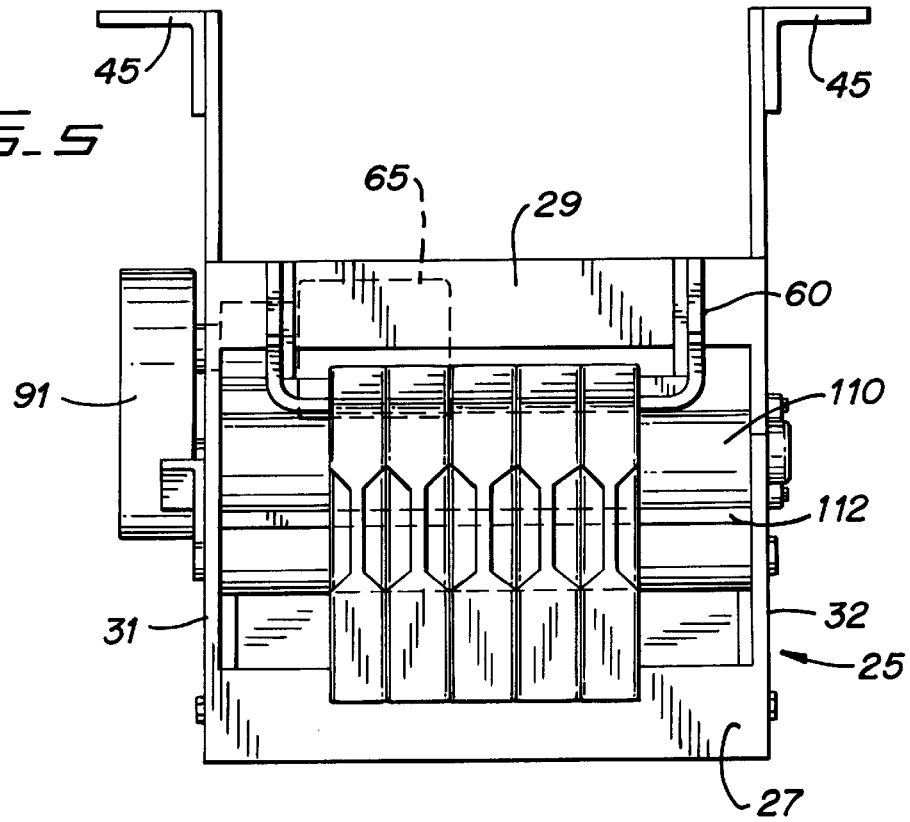
FIG. 5 is a top, plan view of the hard surface preparation device of the present invention.

With continuing reference to FIGS. 2 and 3, power from the output shaft 66 is transferred to the oscillating components of the device 14 by means of a simple transmission 79. The transmission 79 includes a pulley 80 which is mounted on the output shaft 66. Routed around the pulley 80 is a belt 82. The belt 82 is also routed around a second pulley 84 (FIG. 4). The pulley 84 is coupled to an eccentric shaft 90. Thus, when the motor 65 is turned on, the rotation of the output shaft is transferred to the eccentric shaft 90. Although a belt and pulley system is shown, a chain and sprocket system and even a drive axle could be used to transfer power from the motor 65 to the eccentric shaft 90. A more complex transmission having various gears and even a safety clutch could be used if desired. It is preferred that a protective housing 91 (FIG. 1) cover the pulleys 80 and 84 and the belt 82.

The eccentric shaft 90 has a first end 92 and a second end 93. Preferably, the shaft 90 is made from a steel rod having a diameter of about 2" and a length of about 25¼". The ends 92 and 93 are cut, off center, from the shaft 90 to form a first off-center extension 95 with a keyway 96 and a length of about 5¼" and a second off-center extension 97. The extensions 95 and 97 are mounted in apertures 98 and 99 in the plates 31 and 32, respectively. Preferably, the extensions are mounted using two-hole pillow block bearings.

Referring now to FIGS. 3 and 4, the eccentric shaft 90 is driven by the motor 65 through the belt 82 and rotates in an elliptical path. Surrounding the eccentric shaft 90 is a cylindrical sleeve 110. The sleeve 110 is positioned over and around the eccentric shaft and is used to transform the eccentric-rotational movement of the eccentric shaft 90 into a back and forth motion. The sleeve 110 is fitted with two bronze bushings, one on each of its ends, that are about 3" long. Although the sleeve 110 surrounds the eccentric shaft 90, it is otherwise free to move, and as the eccentric shaft 90 rotates in an elliptical path, the sleeve 110 moves in a back and forth manner (oscillation) as is shown by the arrows $O_L$ and $O_R$ in FIGS. 11 and 12. The oscillation is transferred to a spacer 112 which is mounted on the sleeve 110 by welding or the like. The spacer 112 is coupled to a motion transfer shaft 120, by welding, bolting, or other suitable techniques. The motion transfer shaft 120 has a first end 122 mounted in an aperture 125 in the pivot frame 50 and a second end 124 mounted in an aperture 127 (FIG. 6) in the pivot frame 50. Preferably, the motion-transfer shaft is mounted in each aperture with a lock collar. The sleeve 110 and spacer 112, provide a link for coupling the eccentric shaft to other components. The sleeve 110, spacer 112, and motion-transfer shaft 120 provide one means of transforming the elliptical rotational movement of the shaft 90 into a substantially linear oscillation, but other means would be known to those of skill in the art.

Mounted to the pivot frame 50 is a blade mounting plate 130 having a first end 132, a second end 134, and a first side 136. A blade 150 having a front edge 151 is mounted, by bolting or similar fastening techniques, to the blade mounting plate 130 so that is extends beyond the first side 136. The blade is mounted to the mounting plate 130 at an angle ψ of 30° with respect to horizontal.

Preferably, the blade 150 is about 20" long, about 0.02" to about 0.12" thick, and about 4" wide. The blade may be made from tempered spring steel available from Rockwell under the designations C1074/75 and C44/50. The type of material from which the blade is made will depend on the type of material to be removed. The front edge 151 may be rounded or sharpened, also depending on the type of material to be removed. For hard material, a dull blade is preferred. For soft material, a sharp blade is preferred.

As noted above, when the motor 65 is activated, the eccentric shaft 90 rotates in an elliptically-shaped path within the sleeve 110. The sleeve 110, link 112, and motion transfer shaft 120 transform the rotation of the eccentric shaft into a back and forth motion or oscillation. The oscillation is transferred to the blade 150. As the device is applied to a material to be removed, the downward force of the blade as well as the oscillating motion of the blade causes material to be cut away from the underlying harder material.

Preferably, the oscillation applied to the blade causes it to have a "throw" of between about 3/16" to about 5/16". The throw is regulated by the elliptical path of the eccentric shaft 90. The performance of the device 14 is directly related to several variables with respect to the position of and force applied to the blade 150. In the preferred embodiment, the device 14 weights about 400 pounds. The amount of downward force applied to the front edge 151 of the blade 150 varies from about 200 pounds to 1500 pounds depending on how much weight is placed on the frame 60 and how much down force is applied by the arms 18 of the skid-steer tractor 17. It has been found that when a relatively thin layer of material is to be removed, the amount of down force applied to the front edge should be relatively high, otherwise the device 14 tends to bounce over the material. When a relatively thick layer of material is to be removed, less down force is needed. In addition to these variables, the angle at which the front edge 151 strikes the material to be removed will affect the performance of the device 14. As noted above, the angle of the blade is set at about 30° , however, since the device is mounted to the adjustable mounting plate, the angle can be varied by rotating the entire device with respect to the surface of interest (See FIGS. 9 and 10).

Coupled to the pivot frame 50 adjacent to the blade 150 is a shield 160. Preferably the shield is a relatively thin, curved piece of metal. When soft, relatively pliant materials, such as rubber flooring, are removed they will often lift away from the underlying surface in the form of a peel which the shield 160 directs forward to coil within itself. When harder materials are being removed, the shield 160 protects the device from debris that may fly up from the surface being prepared.

Figure 11:
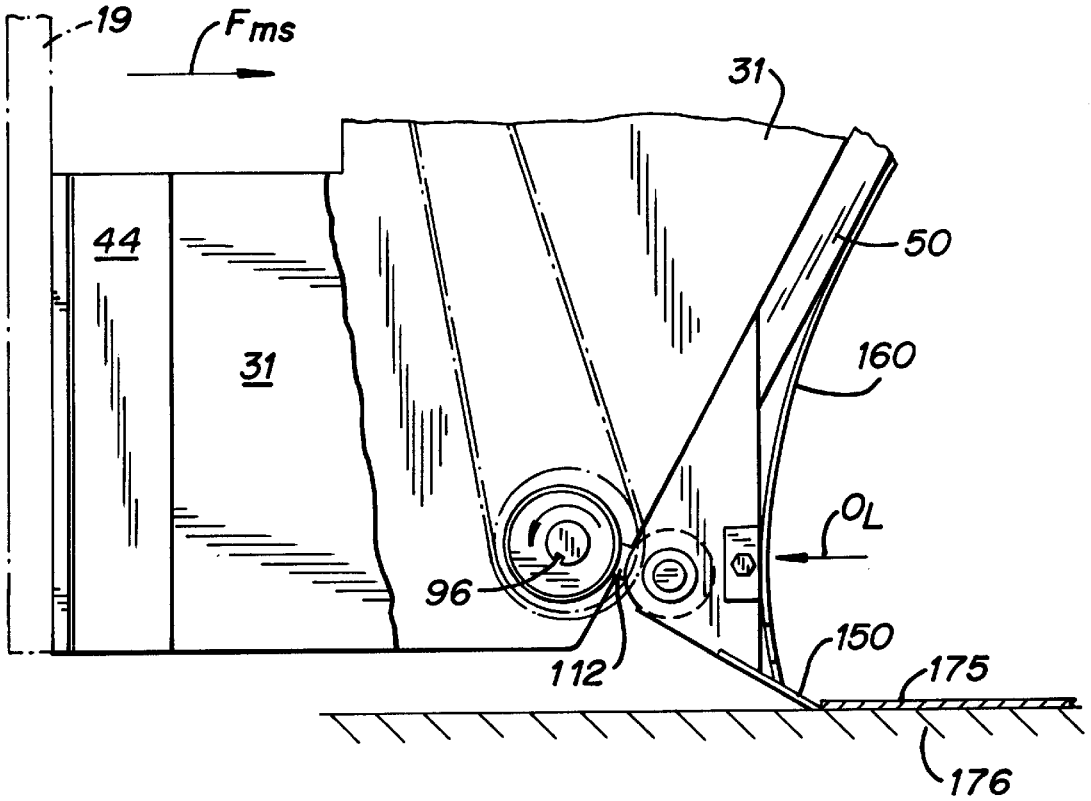
FIG. 11 is right side, partially cut away view of the hard surface preparation device of the present invention shown contacting a layer of material to be removed.
Figure 12:
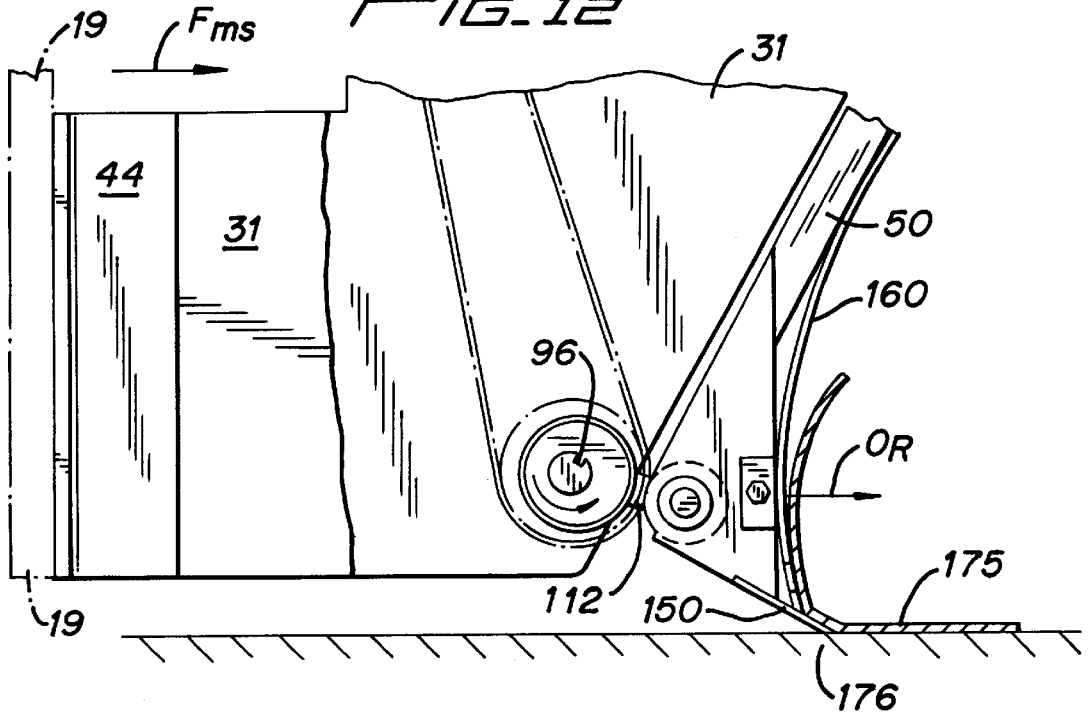
FIG. 12 is another right side, partially cut away view of the hard surface preparation device of the present invention shown removing the layer of material.

As best seen by reference to FIGS. 11 and 12, the device 14 is used to remove a layer of material 175 from an underlying hard material 176. The oscillating movement of the blade 150, as represented by the arrows $O_L$ and $O_R$ is combined with the forward motion of the skid-steer tractor 17 represented by the arrow $F_{MS}$ to remove the material 175. The combined action of these movements has been found to produce far superior results to known methods and devices for removing unwanted material from concrete and other hard surfaces.

Although the invention has been herein shown and described in what is believed to be the most practical and preferred embodiments, it is recognized that departures may be made therefrom within the scope of the invention which is not to be limited to the illustrative details disclosed, but embraces such modified forms thereof as come within the scope of the following claims. In particular, those skilled in the art will recognize that it would be possible to construct the present invention in the form of a self-propelled unit in a manner similar to a large walk-behind lawn mower or the like and, thereby, eliminate the need for the device to be coupled to a small tractor such as the skid-steer tractor 17.

What is claimed is:

1. A device for use with a tractor having one or more power-adjustable arms, the device comprising:

a base frame having first and second plates, each plate including a bracket for being coupled to a mounting plate on the tractor;

a means for providing rotational power having an output shaft;

an eccentric shaft mounted on the base frame and coupled to the output shaft;

a second frame having a first end pivotally mounted to the base frame and a second end having a motion-transfer shaft;

a link positioned between, and coupled to, the eccentric and motion-transfer shafts; and a blade coupled to the motion-transfer shaft;

wherein, when the means for providing rotational power is activated, the eccentric shaft rotates in an elliptically-shaped path which in turn causes the link, the motion-transfer shaft, and the blade to oscillate.

2. The device as claimed in claim 1, further comprising a shield for protecting the base and second frames, the shield coupled to the second frame and positioned adjacent to the blade.

3. The device as claimed in claim 1, wherein the means for providing rotational power is a motor mounted on the base frame.

4. The device as claimed in claim 3, wherein the motor is a hydraulic motor.

5. The device as claimed in claim 1, further comprising a means for holding weights, said means coupled to the base frame.

6. The device as claimed in claim 1, wherein the means for providing rotational power is capable of oscillating the blade at a rate of at least 500 rpm.

7. The device as claimed in claim 1, wherein the blade is positioned at an angle of about 30°.

8. A device for use with a tractor having one or more power-adjustable arms, the device comprising:

a base frame having first and second plates, each plate including a bracket for being coupled to a mounting plate on the tractor;

a motor mounted on the base frame, the motor having an output shaft;

an eccentric shaft mounted on the base frame and coupled to the output shaft of the motor;

a second frame having a first end pivotally mounted to the base frame and a second end having a motion-transfer shaft;

a link positioned between, and coupled to, the eccentric and motion-transfer shafts; and a blade coupled to the motion-transfer shaft of the second frame; wherein, when the motor is activated, the eccentric shaft rotates in an elliptically-shaped path which in turn causes the link, the motion-transfer shaft, and the blade to oscillate.

9. The device as claimed in claim 8, further comprising a shield for protecting the motor and the base and second frames, the shield coupled to the second frame.

10. The device as claimed in claim 8, further comprising a means for holding weights, said means coupled to the base frame.

11. The device as claimed in claim 8, wherein the motor is a hydraulic motor.

12. The device as claimed in claim 8, wherein the motor is capable of oscillating the blade at a rate of at least 500 rpm.

13. The device as claimed in claim 8, wherein the blade is positioned at an angle of about 30°.

14. A device for use with a tractor having a first power-adjustable arm and a second power-adjustable arm substantially parallel to the first power-adjustable arm, the device comprising:

a base frame having a first plate having a mount for being coupled to the first power-adjustable arm and a second plate having a mount for being coupled to the second power adjustable arm of the tractor;

a means for providing rotational power having an output shaft;

an eccentric shaft mounted on the base frame and coupled to the output shaft;

a second frame having a first end pivotally mounted to the base frame and a second end; and a blade coupled to the second end of the second frame and the eccentric shaft;

wherein, when the motor is activated, the eccentric shaft rotates in an elliptically-shaped path which in turn causes the blade to oscillate.

15. The device as claimed in claim 14, further comprising a shield for protecting the base and second frames, the shield coupled to the second frame.

16. A device for use with a tractor having one or more power-adjustable arms, the device comprising:

a base frame having a first side plate with a top end and a bottom end, a second side plate spaced from the first side plate, substantially parallel thereto and having a top end and a bottom end, an opening between the first and second side plates, and a mount for being coupled to the power-adjustable arms of the tractor;

a motor having an output shaft and mounted on the base frame below the top ends of the first and second side plates;

an eccentric shaft mounted on the base frame near the bottom ends of the first and second side plates and coupled to the output shaft;

a second frame positioned in the opening of the base frame and having a first end pivotally mounted to the top ends of the first and second side plates of the base frame and a second end having a motion-transfer shaft;

a link positioned between, and coupled to, the eccentric and motion-transfer shafts;

a blade coupled to the motion-transfer shaft; and a shield spanning the opening between the first and second side plates and for protecting the motor and the base and second frames, the shield coupled to the second frame and positioned adjacent to the blade;

wherein, when the motor is activated, the eccentric shaft rotates in an elliptically-shaped path which in turn causes the link, the motion-transfer shaft, and the blade to oscillate.

17. The device as claimed in claim 16, wherein the motor is a hydraulic motor.

18. The device as claimed in claim 17, wherein the motor is capable of oscillating the blade at a rate of at least 500 rpm.

19. The device as claimed in claim 16, wherein the blade is positioned at an angle of about 30°.

* * * * *